US007310987B1

(12) United States Patent
Rupert

(10) Patent No.: US 7,310,987 B1
(45) Date of Patent: Dec. 25, 2007

(54) BEND-STRAIGHTENING MACHINE WITH VERTICALLY MOVABLE TABLE

(75) Inventor: Reese Rupert, Port Carbon, PA (US)

(73) Assignee: Eitel Presses, Inc., Orwigsburg, PA (US)

( * ) Notice: Subject to any disclaimer, the term of this patent is extended or adjusted under 35 U.S.C. 154(b) by 23 days.

(21) Appl. No.: 11/487,743

(22) Filed: Jul. 17, 2006

(51) Int. Cl.
*B21D 7/06* (2006.01)
*B21D 37/12* (2006.01)
*B21D 9/05* (2006.01)

(52) U.S. Cl. ..... 72/418; 72/389.1; 72/455

(58) Field of Classification Search ..... 72/31.03, 72/380, 389.1, 390.3, 418, 452.1, 455
See application file for complete search history.

(56) References Cited

U.S. PATENT DOCUMENTS 1,840,237 A * 1/1932 Leighton ..... 72/31.03
5,839,315 A * 11/1998 Kubik ..... 72/452.7
6,393,890 B1 * 5/2002 Scholeck ..... 72/390.3

* cited by examiner

*Primary Examiner*—Derris H. Banks
*Assistant Examiner*—Teresa M Bonk
(74) *Attorney, Agent, or Firm*—Anthony J. Casella; Gerald E. Hespos

(57) ABSTRACT

A bend-straightening machine with a vertically movable table for straightening long workpieces is provided. The bend-straightening machine of the present disclosure includes straightening supports for supporting a workpiece mounted on a movable table which moves in a vertical plane driven by a driving mechanism. The machine is constructed as a rigid frame including a base for supporting at least one upright column. A fixed bridge is joined to an upper portion of the upright column and supplies a stationary surface for mounting at least two workpiece holding fixtures, which grip the ends of the workpiece, allowing the workpiece to be rotated. Also, mounted to the bridge is at least one straightening punch which remains stationary during straightening. The moving table and straightening supports act vertically upward on the workpiece causing the workpiece to bend, i.e., straighten, when it contacts the straightening punch.

20 Claims, 2 Drawing Sheets

BEND-STRAIGHTENING MACHINE WITH VERTICALLY MOVABLE TABLE

BACKGROUND

1. Field

The present disclosure relates generally to bend-straightening machines for straightening workpieces, and more particularly, to a bend-straightening machine having a vertically movable table for driving the workpiece against a straightening punch.

2. Description of the Related Art

Bend-straightening machines are known in the art. An exemplary bend-straightening machine is described in U.S. Pat. No. 5,839,315, owned by the assignee of the present application. In U.S. Pat. No. 5,839,315, the actuating mechanism of the machine is based upon cam on roller technology, which utilizes a camshaft mounted in a stationary machine table below straightening bases. The actuating mechanism is designed as a bridge which holds a straightening ram in vertical alignment of a workpiece and the bridge can be moved in a vertical plane by means of a drive mechanism coupled to the camshaft. The bridge is spring-mounted on a base plate of the machine to urge the ram to be in constant engagement with the camshaft to ensure precise alignment with the workpiece. Airbags are also employed are a biasing means to urge the ram against the camshaft.

This known bend-straightening machine operates satisfactorily, but has a disadvantage in that the tonnage and stroke capability of the machine are limited by ergonomic considerations when considering the floor-to-workpiece centerline distance. The large ram structure, which consists of a bridge and uprights, has to be moved with each stroke of the machine requiring a relatively large drive mechanism. Also, due to the plurality of springs supporting the bridge, deformation of any of springs will lead to an asymmetrical load on the workpiece. In addition, the workpiece holding fixtures must be mounted on the fixed machine table and utilize a spring to achieve clamping position, resulting in less than perfect repeatability during measurement.

A bend-straightening machine of similar concept is known from U.S. Pat. No. 6,393,890, also owned by the assignee of the present application. In U.S. Pat. No. 6,393,890, the actuating mechanism consists of cam on roller technology which utilizes a camshaft which is mounted to a rigid machine frame above the workpiece centerline as opposed to below the workpiece centerline as disclosed in U.S. Pat. No. 5,839,315. The actuating mechanism is designed as a ram which holds the straightening punch in vertical alignment of the workpiece and the ram can be moved in the vertical plane by means of the actuating mechanism.

The bend-straightening machine of U.S. Pat. No. 6,393,890 also operates satisfactorily, but has certain disadvantages. The overhead cam arrangement requires the drive mechanism to be mounted to the bridge, which is above the workpiece, requiring a significant support structure in large tonnage machines, thereby increasing its cost. Also, a biasing means, e.g., springs or airbags, are required to bias the cam follower of the ram against the cam to maintain mechanical contact between the cam follower and cam. In addition, the workpiece holding fixtures must be mounted on the fixed machine table and utilize a spring to achieve clamping position, resulting in less than perfect repeatability during measurement.

Therefore, a need exists for a bend-straightening machine having a reduced number of components and which does not require a large support structure. Furthermore, a need exists for a bend-straightening machine that will provide repeatable, accurate straightening of a workpiece.

SUMMARY

A bend-straightening machine with a vertically movable table for straightening long workpieces is provided. The bend-straightening machine of the present disclosure includes straightening supports for supporting a workpiece mounted on a movable table which moves in a vertical plane driven by a driving mechanism. The machine is constructed as a fixed frame including a base for supporting at least one upright column. A fixed bridge is joined to an upper portion of the upright column and supplies a stationary surface for mounting at least two workpiece holding fixtures, which grip the ends of the workpiece, allowing the workpiece to be rotated. Also, mounted to the bridge is at least one straightening punch which remains stationary during straightening. The moving table and straightening supports act vertically upward on the workpiece causing the workpiece to bend when it contacts the straightening punch. The table is then lowered by reversing the driving mechanism.

Advantageously, the moving table will hold the straightening supports by a simple means and can be moved only in a defined, vertical direction relative to the base, upright column(s) and fixed bridge. This causes a load to be exerted by the straightening supports onto the workpiece only from below, independent of the diameter of the workpiece. Thus, a symmetrical load can be exerted on the workpiece by a simple means.

According to one aspect of the present disclosure, a bend-straightening machine for straightening a workpiece includes a frame including at least one upright column and a fixed bridge coupled to an upper portion of the at least one upright column; the bridge including at least two workpiece holding fixtures extending from a lower surface of the bridge for holding the workpiece; a straightening punch extending from the lower surface of the bridge configured to engage the workpiece; a table disposed in the at least one upright column movable in a vertical direction, the table include at least one straightening support disposed on a top surface of the table for engaging the workpiece; and a drive mechanism coupled to the table and configured for reversibly raising and lowering the table relative to the workpiece.

In another aspect, a drive shaft coupled to the drive mechanism and supported in the at least one column, the drive shaft including at least one cam; and at least one cam follower rotatably attached to the table and configured to engage the cam, wherein the drive mechanism transmits a rotational driving motion to the drive shaft causing the cam to reversibly raise and lower the at least one cam follower. The range of motion of the table corresponds to an angle of traverse of the cam which is at least 180 degrees and preferably, the angle of traverse of the cam is approximately 270 degrees.

In a further aspect, each of the at least two workpiece holding fixtures are slidingly mounted to a vertical guide. Optionally, the vertical guide includes at least one fixed stop.

In another aspect, a portion of the table is disposed in a square cavity of the at least one upright column configured to guide movement of the table in a vertical direction. At least two surfaces of the square cavity includes an anti-friction slide plate arrangement configured to eliminate front-to-back motion of the table. The table includes linear guides configured to engage the at least one upright column to eliminate side-to-side motion of the table.

According to another aspect of the present disclosure, a bend-straightening machine for straightening a workpiece includes a frame including a base for supporting the frame, two upright columns spaced apart on the base and a fixed bridge coupled at each end of the bridge to an upper portion of the two upright columns; the bridge including an upper surface and a lower surface, at least two workpiece holding fixtures extending from the lower surface of the bridge for holding the workpiece; a straightening punch extending from the lower surface of the bridge configured to engage the workpiece; a table including a top surface and two projecting ends, each projecting end configured to be disposed in the two upright columns, the table being movable in a vertical direction; two straightening supports disposed on the top surface of the table for engaging the workpiece; and a drive mechanism coupled to the table and configured for reversibly raising and lowering the table relative to the workpiece.

BRIEF DESCRIPTION OF THE DRAWINGS

The above and other aspects, features and advantages of the present disclosure will become more apparent in light of the following detailed description when taken in conjunction with the accompanying drawings in which.

DETAILED DESCRIPTION

Preferred embodiments of the present disclosure will be described hereinbelow with reference to the accompanying drawings. In the following description, well-known functions or constructions are not described in detail to avoid obscuring the disclosure in unnecessary detail.

Figure 1:
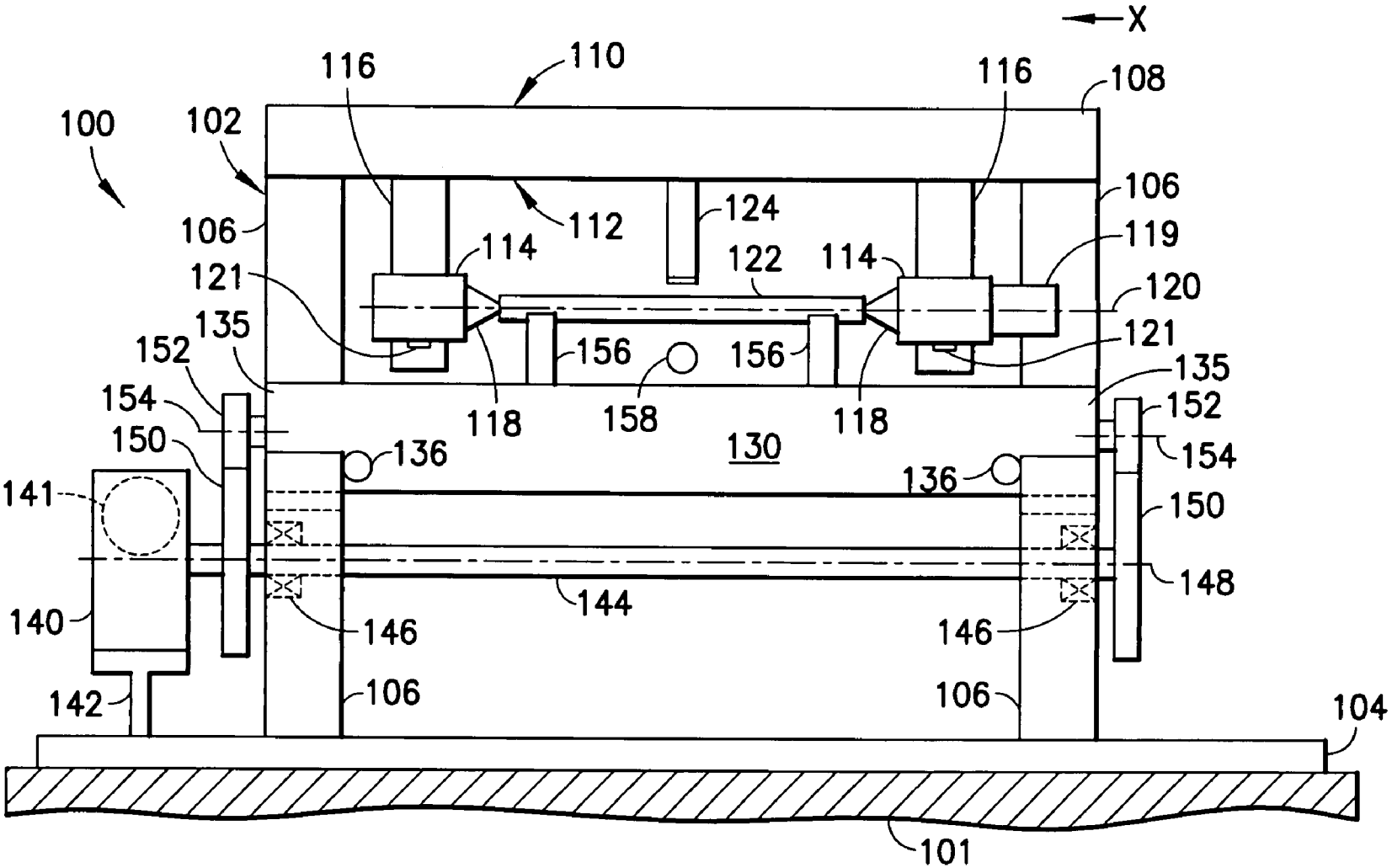
FIG. 1 is a front view of a bend-straightening machine according to an embodiment of the present disclosure.
Figure 2:
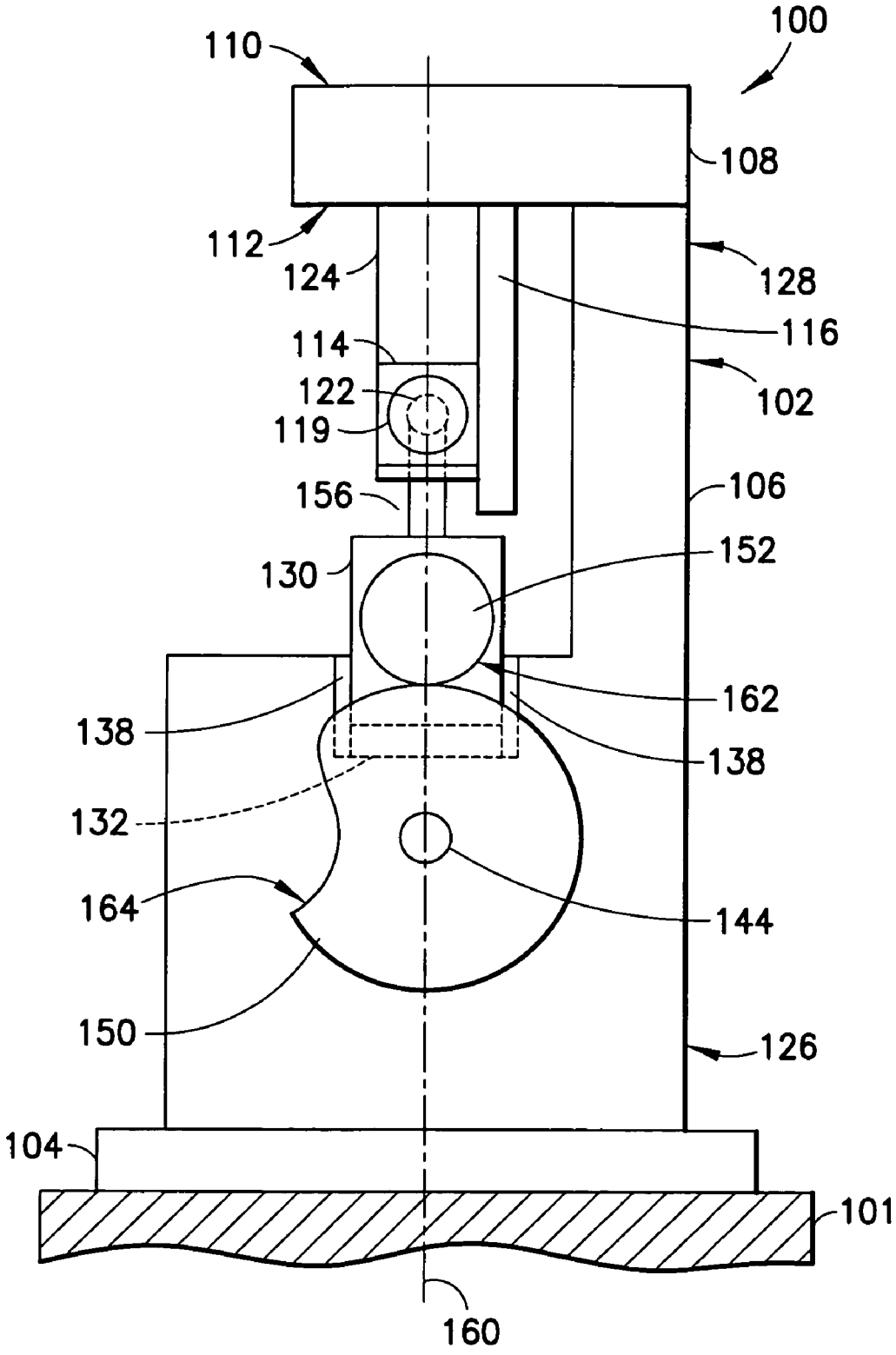
FIG. 2 is a side view of the bend straightening machine as viewed along arrow X in FIG. 1.

A bend-straightening machine in accordance with the present disclosure is illustrated in FIGS. 1 and 2 and is generally indicated by reference numeral 100. The machine 100 is generally constructed as a rigid, fixed frame 102. The frame 102 includes a generally rectangular base 104 for supporting the frame 102 on a floor 101, two upright columns 106 spaced apart on the base 104 and a fixed bridge 108 which is joined at each end to an upper portion of the upright columns 106. It is to be appreciated that the machine is constructed as an open frame which will allow for easy access to the workpiece and tooling as required by the straightening process.

The bridge 108 is generally rectangular and includes an upper surface 110 and a lower surface 112. Two workpiece holding fixtures 114 are disposed on the lower surface 112 of the bridge 108 in a spaced apart relationship. Each holding fixture 114 includes a vertical guide 116 and a gripping tool 118 configured to allow a workpiece, e.g., a cylindrical rod, to be grasped at its ends and rotated about its longitudinal axis 120. The gripping tool 118 may be in the form of a spindle sleeve with centers which engage matching countersinks in the ends of workpiece 122. At least one of the gripping tools will include a motor 119 for rotating the workpiece 122 along its longitudinal axis 120.

The gripping tools 118 are slidingly mountable to each vertical guide 116 and will be positioned along each vertical guide 116 at a pre-determined centerline height set by the fixed stop 121. The workpiece holding fixtures 114 will be independently guided in a vertical plane 160 by the vertical guides 116. Each vertical guide 116 includes at least one adjustable fixed stop 121 to ensure repeatable, accurate positioning of the workpiece 122 allowing for a significant increase in straightening accuracy. At least one straightening punch 124 is mounted to the lower surface 112 of the bridge 108, which remains fixed during the straightening process.

Each upright column 106 includes a lower portion 126 and an upper portion 128. The upper portion 128 supports the bridge 108. The lower portion 126 rests on the base 104 and supports a moving table 130. The moving table 130 is the actuating mechanism of the bend-straightening machine 100 of the present disclosure. As can best be seen in FIG. 2, the lower portion 126 of the column 106 includes a square cavity 132 for receiving an end of the table 134. The table is generally rectangular and includes projecting ends 135 for being disposed in the cavity 132 of the upright columns. The cavity 132 is configured to guide the table 130 in a vertical direction when actuated. Roller-type linear guides 136 are provided on the table 130 to come into contact with the column 106 to eliminate side-to-side motion of the table 130. Additionally, the square cavity 132 includes an anti-friction slide plate arrangement 138 to eliminate front-to-back motion of the table 130. With these guides properly adjusted, the moving table 130 moves only in the vertical plane 160, transmitting the actuation force for the bend-straightening machine. Since the table 130 is guided perpendicular to its direction of motion, exceptional stroke repeatability results. Furthermore, the table is self-supporting and does not require any external means of anti-gravity safety supports.

The table 130 is actuated by a drive mechanism 140. The drive mechanism 140 is coupled to the base 104 by a drive mechanism support 142. A drive shaft 144 is coupled to the drive mechanism 140 and supported in the each upright column 106 by bearings 146. The bearings 146 provide a means of rotational support for the drive shaft 144 which is coupled to the drive mechanism 140 to transmit a rotational driving motion to the drive shaft 144. In one embodiment, the drive mechanism 140 includes an electric motor 141 and a step-down gear unit coupling the motor 141 to the drive shaft 144 for transferring the rotational driving motion to the drive shaft 144. It is to be appreciated that other types of motors, e.g., hydraulic motors, may be employed to transfer the rotational driving motion to the drive shaft. The drive shaft 144 is fixed in its axial direction. The axis of rotation 148 of the drive shaft 144 is parallel to the axis of rotation 120 of the workpiece 122.

A cam 150 is fixedly attached to each end of the drive shaft 144 which extends beyond the upright column 106. The table 130 has a cam follower 152 rotatably attached to each projecting end 135, which come to rest against each cam 150 due to gravitational force when table 130 is placed in the frame 102. Due to the gravitational force acting on the table 130, a curved peripheral surface 162 of the cam follower 152 is pressed or biased against the curved peripheral surface 164 of the cam 150 causing them to interact. The axis of rotation 154 of the cam follower 152 is parallel to the axis of rotation 148 of the drive shaft 144. Advantageous to moving the drive shaft 144 and cams 150 below the moving table 130 is the ability to eliminate the springs or airbags required by prior art machines, replacing them with gravity as the biasing force.

The movement of the table 130 thus takes place by means of the driven cam 150 which interacts with the cam follower 152 on the table 130. Such a design is suitable for producing both a downward movement as well as an upward movement of the moving table. With the cam follower 152 of the table 130 being above and resting upon the cam disk 150, gravitational force ensures that the cam follower 152 always rests against the cam 150 and is raised or lowered depending upon the particular angular position of the cam 150. Depending on the angular position of the cam 150, the cam follower 152 which is coupled to the table 130, is actively raised or lowered. The cams 150 are designed in such a way that the feed travel of the table 11 corresponds to an angle of traverse of more than 180 degrees of the cams 150, and preferably, the angle of traverse is approximately 270 degrees of the cams 150. The cam follower 152 may be provided in the form of a roller so that relative motion between the cam follower 152 and the cam 150 can take place largely without friction.

Mounted of a top surface of the moving table 130 are at least two straightening supports 156. Optionally, at least one measuring instrument 158 is disposed on the top surface of the table 103 for determining the deflection of the workpiece 122. It is to be appreciated that a plurality of measuring instruments may be employed depending on the number of deflection points, or straightening points, of the workpiece. The straightening supports 156 hold the workpiece 122 as the workpiece 122 is loaded into the machine 100. Also, the straightening supports 122 support the workpiece 122 during straightening as the moving table 130 is raised to engage the workpiece 122 against the straightening punch 124. In operation, the driving mechanism 140 will cause the table to rise in a vertical direction lifting the workpiece 122 on the straightening supports 156 causing the workpiece to bend, i.e., straighten, when it contacts the straightening punch 124.

In the vertical alignment of the workpiece 122, the moving table 130 holds the straightening supports 156. The fixed straightening punch 124 is arranged in vertical alignment between the two straightening supports 156 and is positioned symmetrically to plane 160 which passes through the axis 148 of the drive shaft 144 and the axis 120 of the workpiece 122. This ensures the straightening supports 156 always act upon workpiece 122 precisely from below when the table 130 is moved in a vertical direction, independent of the diameter of the workpiece 122.

A bend-straightening machine with a vertically movable table has been described. The bend-straightening machine according to the present disclosure enables a structure with a reduced amount of mass as compared to prior art machines which allows more efficient drive components and reduced energy consumption. Furthermore, the bend-straightening machine of the present disclosure eliminates the need for a biasing means such as airbags or springs to keep the ram or bridge in the top position and provides a lowered working height of the machine and tooling, easier transportation of a workpiece through the machine and reduced manufacturing costs.

It is to be understood that the machine can be extensively modified within the scope of the present disclosure. Thus, the straightening support(s) 156 and the straightening punch 124 are expediently movable in the longitudinal direction of workpiece 122, an additional drive mechanism to rotate the workpiece can be provided, and the feed travel of the table can also take place by suitable means other than cam disks. It is further to be appreciated that the workpiece to be straightened may take many forms including but not limited to armature shafts, camshafts, crankshafts, transmission shafts, round axles, square axles, axle housings, pinion gears, steering racks, tubing, gun barrels, flat stock, bar stock, golf clubs shafts, railroad tracks, elevator guide rails, oil well drill housings, etc..

While the disclosure has been shown and described with reference to certain preferred embodiments thereof, it will be understood by those skilled in the art that various changes in form and detailed may be made therein without departing from the spirit and scope of the disclosure as defined by the appended claims.

What is claimed is:

1. A bend-straightening machine for straightening a workpiece comprising:

a frame including at least one upright column and a fixed bridge coupled to an upper portion of the at least one upright column;

the bridge including at least two workpiece holding fixtures extending from a lower surface of the bridge for holding the workpiece, a straightening punch extending from the lower surface of the bridge configured to engage the workpiece;

a table disposed in the at least one upright column movable in a vertical direction, the table include at least one straightening support disposed on a top surface of the table for engaging the workpiece; and a drive mechanism coupled to the table and configured for reversibly raising and lowering the table relative to the workpiece.

2. The machine as in claim 1, further comprising:

a drive shaft coupled to the drive mechanism and supported in the at least one column, the drive shaft including at least one cam; and at least one cam follower rotatably attached to the table and configured to engage the cam, wherein the drive mechanism transmits a rotational driving motion to the drive shaft causing the cam to reversibly raise and lower the at least one cam follower.

3. The machine as in claim 2, wherein the range of motion of the table corresponds to an angle of traverse of the cam which is at least 180 degrees.

4. The machine as in claim 3, wherein the angle of traverse of the cam is approximately 270 degrees.

5. The machine as in claim 2, wherein the drive shaft is rotationally supported on bearings in the at least one upright column.

6. The machine as in claim 2, wherein the axis of rotation of the drive shaft is parallel to the axis of rotation of the workpiece and below the workpiece.

7. The machine as in claim 1, wherein each of the at least two workpiece holding fixtures are slidingly mounted to a vertical guide.

8. The machine as in claim 7, wherein the vertical guide includes at least one fixed stop.

9. The machine as in claim 7, wherein at least one of the at least two workpiece holding fixtures includes a motor for rotating the workpiece along its longitudinal axis.

10. The machine as in claim 1, wherein a portion of the table is disposed in a square cavity of the at least one upright column configured to guide movement of the table in a vertical direction.

11. The machine as in claim 10, wherein at least two surfaces of the square cavity includes an anti-friction slide plate arrangement configured to eliminate front-to-back motion of the table.

12. The machine as in claim 11, wherein the table includes linear guides configured to engage the at least one upright column to eliminate side-to-side motion of the table.

13. The machine as in claim 10, further comprising:

a drive shaft coupled to the drive mechanism and supported in the at least one column below the square cavity, the drive shaft including at least one cam; and at least one cam follower rotatably attached to the table and configured to engage the cam due to a downward gravitational force on the table, wherein the drive mechanism transmits a rotational driving motion to the drive shaft causing the cam to reversibly raise and lower the at least one cam follower.

14. The machine as in claim 1, further comprising at least one measuring instrument disposed on the top surface of the table for determining the deflection of the workpiece.

15. The machine as in claim 1, further comprising two straightening supports, wherein each straightening support is movable in a longitudinal direction of the workpiece.

16. A bend-straightening machine for straightening a workpiece comprising:

a frame including a base for supporting the frame, two upright columns spaced apart on the base and a fixed bridge coupled at each end of the bridge to an upper portion of the two upright columns;

the bridge including an upper surface and a lower surface, at least two workpiece holding fixtures extending from the lower surface of the bridge for holding the workpiece, a straightening punch extending from the lower surface of the bridge configured to engage the workpiece;

a table including a top surface and two projecting ends, each projecting end configured to be disposed in the two upright columns, the table being movable in a vertical direction, two straightening supports disposed on the top surface of the table for engaging the workpiece; and a drive mechanism coupled to the table and configured for reversibly raising and lowering the table relative to the workpiece.

17. The machine as in claim 16, further comprising:

a drive shaft coupled to the drive mechanism and supported in the two upright columns;

two cams fixedly attached to the drive shaft, each cam being mounted to an end of the drive shaft extending beyond each of the two upright columns ; and two cam followers each rotatably attached to the projecting ends of the table and configured to engage the cam due to gravitational force, wherein the drive mechanism transmits a rotational driving motion to the drive shaft causing the cam to reversibly raise and lower the two cam followers.

18. The machine as in claim 17, wherein each projecting end of the table is disposed in a square cavity of each of the two upright columns configured to guide movement of the table in a vertical direction.

19. The machine as in claim 18, wherein at least two surfaces of the square cavity includes an anti-friction slide plate arrangement configured to eliminate front-to-back motion of the table.

20. The machine as in claim 19, wherein the table includes linear guides configured to engage each of the two upright columns to eliminate side-to-side motion of the table.

* * * * *